US005654503A

United States Patent [19]

Rasmus

[11] Patent Number: 5,654,503

[45] Date of Patent: Aug. 5, 1997

[54] METHOD AND APPARATUS FOR IMPROVED MEASUREMENT OF DRILLING CONDITIONS

[75] Inventor: John C. Rasmus, Richmond, Tex.

[73] Assignee: Schlumberger Technology Corporation, Sugar Land, Tex.

[21] Appl. No.: 710,043

[22] Filed: Sep. 11, 1996

Related U.S. Application Data

[63] Continuation of Ser. No. 325,846, Oct. 19, 1994, abandoned.

[51] Int. Cl.[6] ..... E21B 44/00

[52] U.S. Cl. ..... 73/152.43; 73/152.46; 364/422

[58] Field of Search ..... 73/151, 152.01, 73/152.43, 152.46; 364/422

[56] References Cited

U.S. PATENT DOCUMENTS

| | | | |
|---|---|---|---|
| 4,662,458 | 5/1987 | Ho | 175/27 |
| 4,804,051 | 2/1989 | Ho | 175/26 |
| 4,848,144 | 7/1989 | Ho | 73/151 |
| 4,972,703 | 11/1990 | Ho | 73/151 |
| 5,044,198 | 9/1991 | Ho | 73/151 |
| 5,181,172 | 1/1993 | Whitten | 364/422 |
| 5,272,680 | 12/1993 | Stone et al. . | |
| 5,277,061 | 1/1994 | Draoui | 73/151 |
| 5,321,981 | 6/1994 | Macpherson | 73/151 |
| 5,431,046 | 7/1995 | Ho | 73/151 |

OTHER PUBLICATIONS

Nelson, et al. "Improved Vertical Resolution of Well Logs by Resolution Matching", *The Log Analyst* (Jul.–Aug. 1991), pp. 339–349.

*Primary Examiner*—Hezron E. Williams
*Assistant Examiner*—Jay L. Politzer
*Attorney, Agent, or Firm*—Anthony V. S. England; Wayne I. Kanak; Albert J. Adamcik

[57] ABSTRACT

In drilling a well, a condition at the surface which contributes to a downhole condition is identified. A set of observed measurements is collected for the surface and downhole conditions. From this set of observations a predictor equation is derived which expresses the downhole condition as a function of the measured surface condition. After the predictor equation has been developed, it is applied to a measured surface condition to estimate the resulting downhole condition.

25 Claims, 6 Drawing Sheets

METHOD AND APPARATUS FOR IMPROVED MEASUREMENT OF DRILLING CONDITIONS

This is a continuation of application Ser. No. 08/325,846, filed Oct. 19, 1994, now abandoned.

BACKGROUND OF THE INVENTION

1. Field of the Invention

This invention relates generally to methods and apparatus for measuring conditions downhole in a well drilling operation, and particularly to a method and apparatus for combining a downhole measurement with a related measurement at the surface of a well.

2. Background Art

Downhole conditions can be measured at high sample rates, but the data cannot be transmitted uphole rapidly while drilling. These measured conditions are typically transmitted by sending pressure pulses through the drilling mud which fills the drill string connecting the drill bit to the surface. Sending these pulses through the drilling mud provides only one transmission path, so data must be transmitted in serial fashion. Since this transmission method limits data rates to approximately several bits of data per second, and since transmitting a single downhole measurement to the surface requires a number of bits of data, it requires as much as several seconds of transmission time to send a measurement signal from downhole to the surface.

Also, there are numerous downhole conditions of interest to be measured in drilling a typical well. Serial transmission requires that each of these measurements must wait its turn to be transmitted.

In addition to being limited to a single, serial data path for transmitting numerous measurements, there is also a limit to the speed of transmission along the data path. It typically requires 2 to 3 seconds for a signal to travel from downhole, up through the mud in the drill string, and to the surface. Although a downhole condition may be sampled much more frequently by downhole measurement devices, because of these other limitations, in many applications the measurement of a single downhole condition might be updated at the surface only about once every 30 to 60 seconds.

For a variety of reasons it is desirable to overcome the above described constraints to obtaining a rapid indication of the downhole effect of a surface condition. A drilling record with frequent updates may be useful after drilling for interpreting results of the drilling operation. Also, an operator needs downhole information in order to make timely adjustments in controlling the drilling process so that changing conditions can be detected and analyzed, such as changes in the friction between the drill string and the wellbore, the condition of the drill bit, and the lithology of the formation. These adjustments are important in order to maximize the rate of penetration and to drill safely, thereby minimizing expensive drilling time.

SUMMARY OF THE INVENTION

The main object of the invention is to provide frequent surface updates of a measured downhole condition during drilling to immediately indicate the effect that a surface condition has had downhole.

According to the invention a condition at the surface which produces or contributes to the downhole condition is first identified. A set of observed measurements is collected for the surface and downhole conditions. From this set of observations a predictor equation is derived which expresses the downhole condition as a function of the measured surface condition. After the predictor equation has been developed, it is applied to a measured surface condition to estimate the resulting downhole condition.

In order to best assist the drilling operator, a display of the downhole condition, which may be a graphical or numerical display, may be generated. The predictor equation may be applied to succeeding observations of the surface condition to provide a systematically updated display. The predictor equation may also be updated to take into account changing drilling conditions by collecting additional sets of surface and downhole measurements and deriving a new predictor equation. The additional measurements may be collected continuously, periodically or from time to time.

The main object of the invention and other objects will be evident in the detailed description that follows.

BRIEF DESCRIPTION OF THE DRAWINGS

FIG. 3(*a*) shows the magnitude of observed surface measurements, S, and downhole measurements, D, plotted against a time scale, t.

FIG. 3(*b*) shows the same observations, S and D, plotted against the time of each observation, with the downhole measurements time shifted to account for the time lag between the occurrence of a surface condition and the receipt at the surface of the corresponding transmitted downhole measurement.

FIG. 3(*c*) shows the same, time shifted measurement D and a filtered version, $\overline{S}$, of the surface measurement, S, both plotted against time, t.

FIG. 3(*d*) shows $\overline{S}$ and the time shifted observations of D with additional, interpolated values of D, all being plotted against time, t.

In FIG. 3(*e*) the pairs of observations D and $\overline{S}$ are plotted with D as the ordinate and $\overline{S}$ as the abscissa. FIG. 3(*e*) also shows the locus of the derived equation $\hat{D}=f(\overline{S})$.

FIG. 3(*f*) shows the equation $\hat{D}=f(\overline{S})$ being applied for a single observation of S to immediately indicate the effect that a surface condition will have downhole.

DESCRIPTION OF THE INVENTION

In a case where the torque on the drill bit downhole is the drilling condition of interest, the torque applied to the drill string at the surface is identified as a condition at the surface which produces or contributes to the downhole condition. After a certain lag between the time of applying torque to the drill string at the surface, transferring the torque from one end of the drill string down to the bit, and delivering the torque at the bit, the torque delivered downhole will correspond to the torque applied to the drill string at the surface, except for friction effects caused by interaction between the drill string and the borehole.

In the case of a drill string comprising a downhole motor-driven bit, the motor driver will also contribute to torque on the bit. A surface measurable condition contributing to the downhole motor torque may also be included in the analysis. For example, pressure on the surface at the inlet to a standpipe supplying fluid for driving the motor may be measured as a contributor to the downhole torque.

In another case the condition of interest downhole may be the weight on the bit. In such a case it is assumed that the weight of the drill string is known and the amount of weight that is supported at the surface can be measured as the varying surface measured contribution to the downhole condition.

It is well known how to measure downhole and surface conditions such as those just described. The weight on a bit downhole is measured, for example, by a strain gage attached to a collar in the drill string just above the bit as described in U.S. Pat. No. 4,359,898, which is incorporated herein by reference. The varying weight supported at the surface is also measured by a strain gage connected to the support mechanisms at the surface which are used to control the weight on the bit.

It is also well known how to transmit signals representing such downhole measurements to the surface, such as by converting the measurement to digital bits of information and transmitting the bits as pulses through drilling mud within the drill string.

Figure 1:
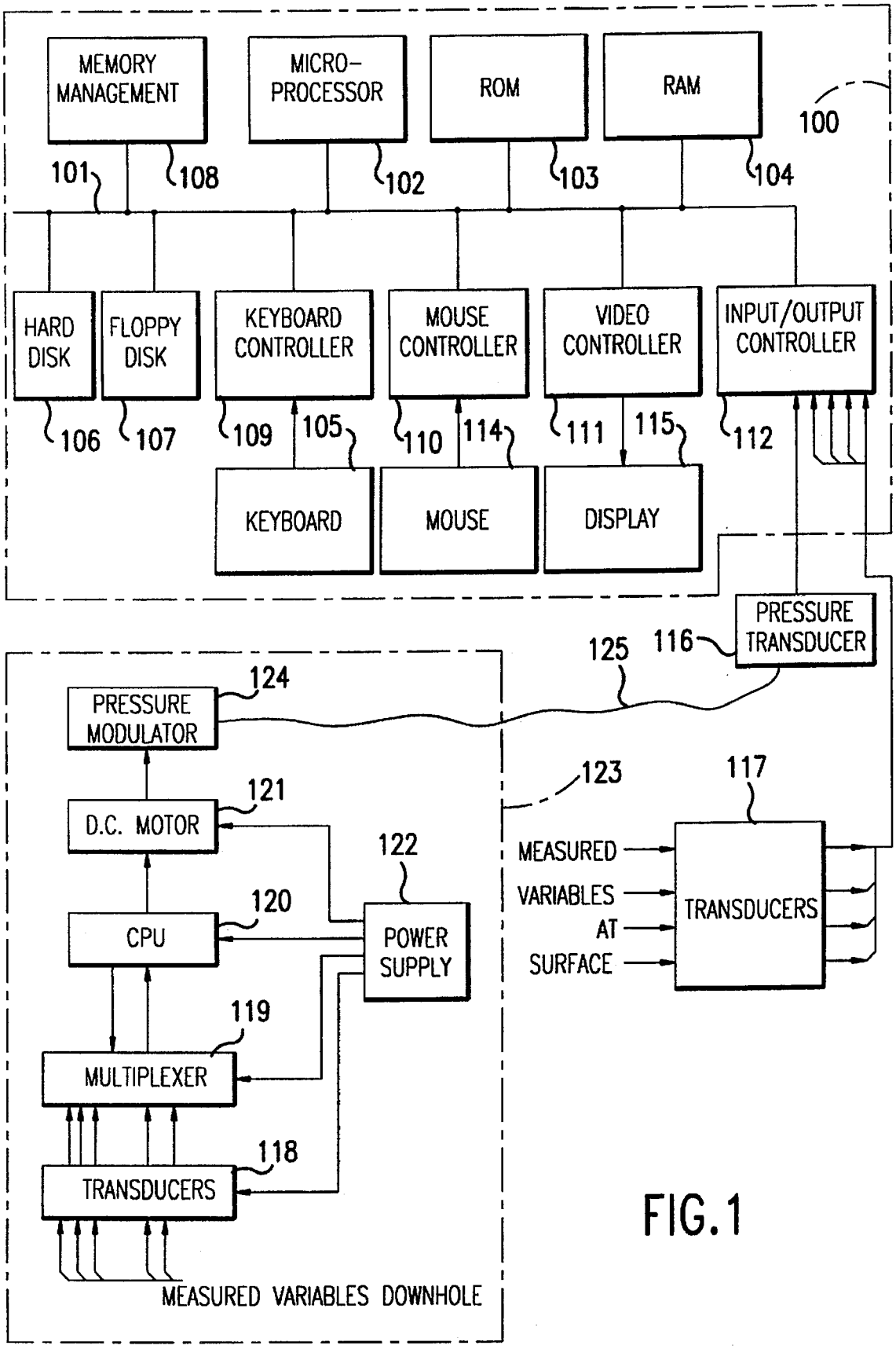
FIG. 1 shows a block diagram of the components of the apparatus.

FIG. 1 shows a block diagram of the components of the drilling measurement apparatus. The apparatus includes a computer 100 with a system bus 101 to which various components are coupled and by which communication between the various components is accomplished. A microprocessor 102 is connected to the system bus 101 and is supported by read only memory (ROM) 103 and random access memory (RAM) 104 also connected to system bus 101. The microprocessor 102 is one of the Intel family of microprocessors including the 8088, 286, 388, 486, or 586 microprocessors. However, other microprocessors, including but not limited to Motorola's family of microprocessors such as 68000, 68020, or the 68030 microprocessors and various Reduced Instruction Set Computer (RISC) microprocessors manufactured by IBM, Hewlett Packard, Digital, Motorola and others may be used.

The ROM 103 contains code including the Basic Input/Output System (BIOS) which controls basic hardware operations such as the interactions of the keyboard 105 and disk drives 106 and 107. The RAM 104 is the main memory into which the operating system and the image application programs are loaded, including the user interface of the present invention. The memory management chip 108 is connected to the system bus 101 and controls direct memory access operations including passing data between the RAM 104 and a hard disk drive 106 and floppy disk drive 107.

Also connected to the system bus 101 are four controllers: the keyboard controller 109, the mouse controller 110, the video controller 111, and the input/output controller 112. The keyboard controller 109 is the hardware interface for the keyboard 105, the mouse controller 110 is the hardware interface for the mouse 114, the video controller 111 is the hardware interface for the display 115, and the input/output controller 112 is the hardware interface for the transducers 116 and 117.

The required downhole conditions are measured by transducers 118. Signals from the transducers 118 are fed via a multiplexer 119 to a microprocessor (CPU) 120 which controls a D.C. motor 121 in a Measurement-While-Drilling telemetry tool such as that described in U.S. Pat. No. 5,237,540, which is incorporated herein by reference. An electric battery or power generating turbine provides a power supply 122 for the downhole assembly 123. Modulation of the D.C. motor 121 controls the pressure modulator 124 which generates the pressure pulse signals transmitted up through the mud in the drill string as represented by line 125 to a pressure transducer 116 on the drilling rig (not shown). The required surface conditions are measured by transducer 116 on the drilling rig (not shown). The required surface conditions are measured by transducers 117. The transducers 116 and 117 provide inputs to the input/output controller 112.

Figure 2:
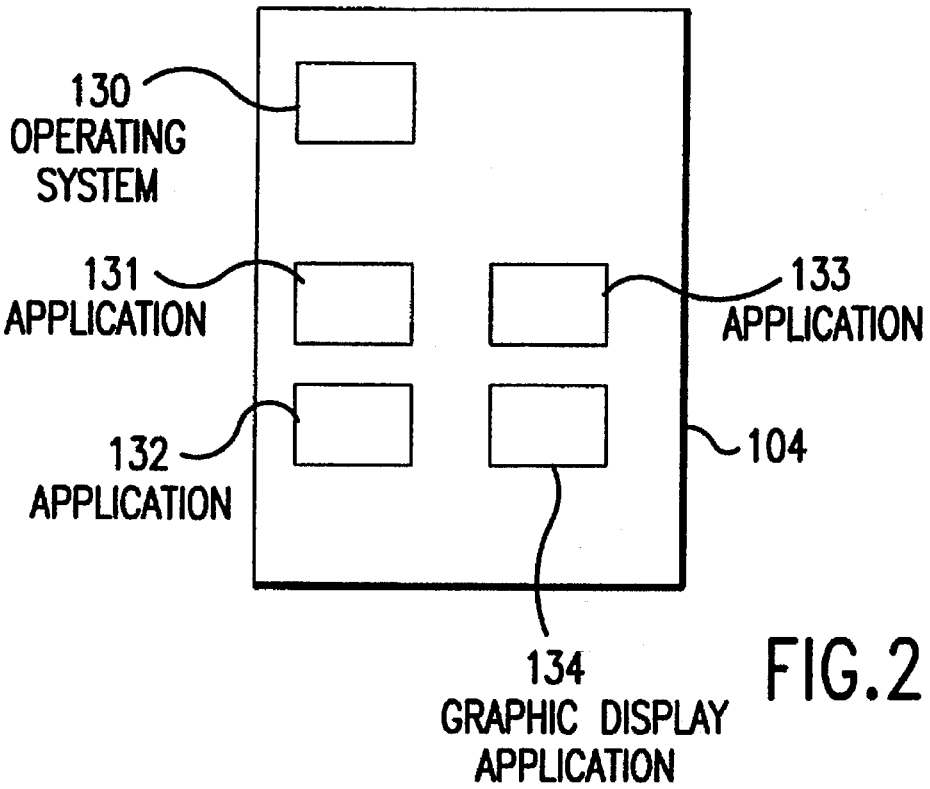
FIG. 2 depicts several applications active in system memory of a computer which is a component of the apparatus.

The operating system on which the preferred embodiment of the invention is implemented is Microsoft's WINDOWS NT, although it will be understood that the invention could be implemented on other and different operating systems. As shown in FIG. 2, an operating system 130 is shown resident in RAM 104. The operating system 130 is responsible for determining which user inputs from the keyboard 105 and the mouse 114 in FIG. 1 go to which of the applications, transmitting those inputs to the appropriate applications and performing those actions as specified by the application and response to that input. For example, the operating system 130 would display the result of the graphic display application 134 to the user on the graphic display 115 in FIG. 1. Among the applications resident in RAM 104 are a plurality of applications 131 through 134 for processing inputs from transducers, transforming processed inputs into historical data tables, and performing numerical analysis such as filtration, cross correlation, and regression analysis.

Figure 4:
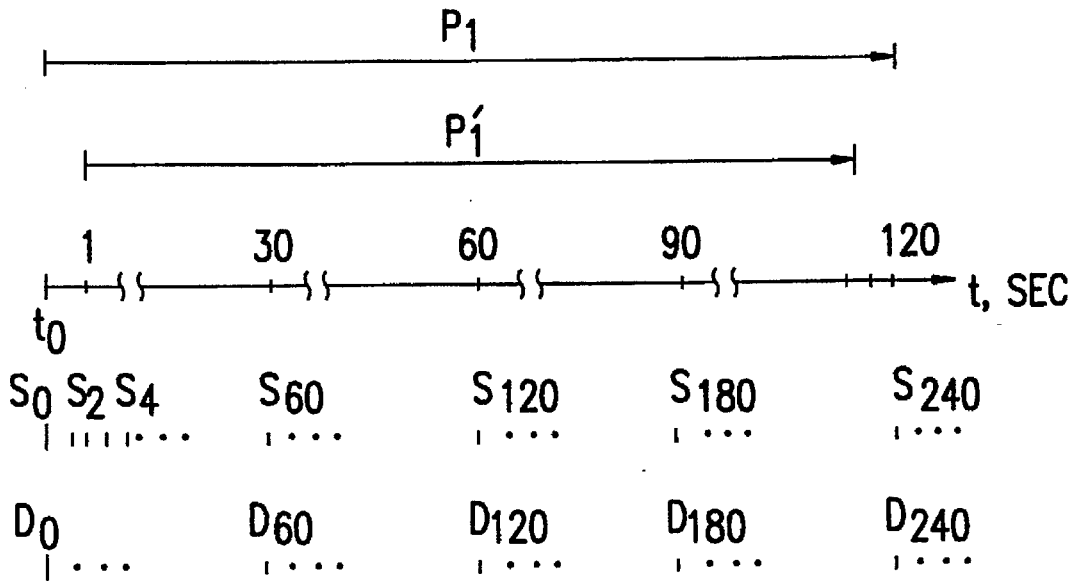
FIG. 4 shows a numbered sequence of observations of S and D in relation to a time scale.

As shown in FIG. 3(*a*), over a period of time a set of the surface measurements, S, and the downhole measurements, D, are collected for the condition of interest. As discussed above, due to transmission rate limitations and because there are a number of conditions being monitored downhole, the downhole condition can only be updated infrequently in comparison to the surface measurement. For the purpose of illustration, in the present example the condition D is measured numerous times during a 30 second period and an average sample value is calculated for the numerous samples. Thus, as shown in FIG. 4, for a period of 120 seconds a total of four average downhole samples are obtained. For the purpose of assigning a time correspondence between downhole and surface measurements, the average of a set of downhole samples is considered to have occurred at the end of the 30 second period from which it was calculated.

The condition of interest as measured on the surface is referred to here as S. In this example, the surface condition is sampled once every ½ second over the same 120 second period for a total of 240 measurement samples, $S_1, S_2, \ldots S_{240}$. Four of the 240 samples of S are considered to be measured at the same time as the averaged, sampled values of D. In order to index the correspondence in time between the observations of D and those of S, the four values of D may be referred to as $D_{60}$, $D_{120}$, $D_{180}$, and $D_{240}$, as shown in FIG. 4.

Figure 5:
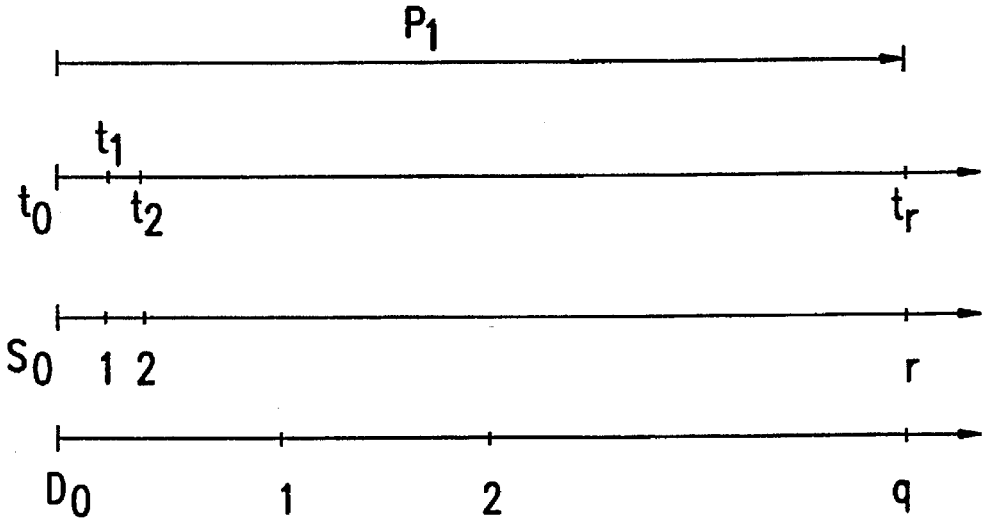
FIG. 5 is a more general depiction of the sequence of observations of FIG. 4.

Stated more generally, and as shown in FIG. 5, there are r measurement samples of S, referred to as $S_1, S_2, \ldots S_r$, the samples being observed at times $t_1, t_2, \ldots t_r$ over a period of time $P_1$. There are q averaged measurement samples of D.

Some synchronizing technique must be employed to identify the time correspondence of the downhole and surface samples. The delay associated with collecting a downhole measurement may be calculated based on known characteristics of the components involved in sensing the downhole condition, modulating the measurement, transmitting the measurement signal and demodulating. The calculated delay time may then be used to identify the time of a downhole measurement sample with respect to a reference time at which the surface measurement is sampled and eliminate the resulting offset in the data sets as shown in FIG. 3(*b*). Alternatively, the time offset between the surface and downhole measurements could be determined by cross-correlation or fast Fourier transform algorithms. According to a typical cross-correlation algorithm, a reference time period is selected such that the period encompasses a number of downhole samples. For a first iteration, the sum of the products of corresponding downhole and surface samples over the reference time period is then calculated. For the downhole samples, in the next iteration the reference time period is shifted to a start time one downhole sample later than in the first iteration. The period remains fixed for the surface samples. The shifting of the time period with respect to the downhole samples yields a new set of corresponding downhole and surface samples. A new sum of the products of the new set of corresponding downhole and surface samples is then computed and compared with the sum from the first iteration. This process is repeated where the time period is shifted and a new sum is calculated and compared with previous sums over a range of time shifts. The range is based on an estimate of the maximum downhole sample delay. Within this range of time shifts the time shift which yields the maximum sum is assumed to correspond to the downhole sample delay time. According to a typical Fourier transform algorithm the sets of downhole and surface measurements are transformed to the frequency domain and a phase shift is determined which defines the time shift between signals.

From this set of observations a predictor equation is derived which expresses the downhole condition as a function of the measured surface condition. First, the surface measurements are filtered in order to conform the frequency response of the surface measurements to that of the downhole measurements, as shown in FIG. 3(*c*). In our example, a finite interval response filter is used. An n level, finite interval response filter has the form:

$$\bar{S}_i=(A_{i-n}*S_{i-n})+\ldots+(A_i*S_i)+\ldots+(A_{i+n}*S_{i+n})$$

If a two level filter of this type is used, then a first value of $\bar{S}$ can be calculated as:

$$\bar{S}_2=(A_0*S_0)+(A_1*S_1)+(A_2*S_2)+(A_3*S_3)+(A_4*S_4)$$

The next observation of $\bar{S}$ will be:

$$\bar{S}_3=(A_1*S_1)+(A_2*S_2)+(A_3*S_3)+(A_4*S_4)+(A_5*S_5)$$

And so on.

Figure 6A:
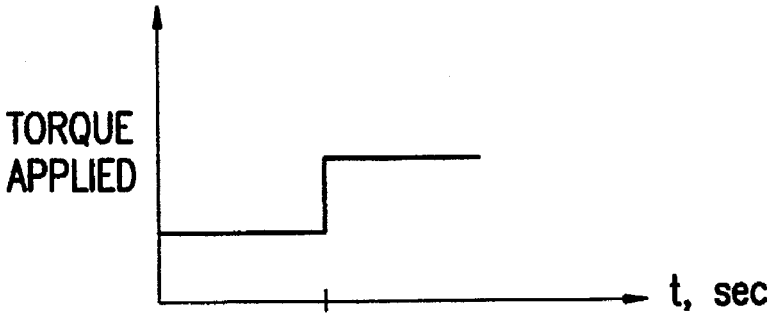
FIG. 6 shows a step change in time, t, of an torque, T, applied to the drill string and the "responses" of the system, that is, the resulting torque, S, measured at the surface and the resulting torque, D, measured downhole.
Figure 6B:
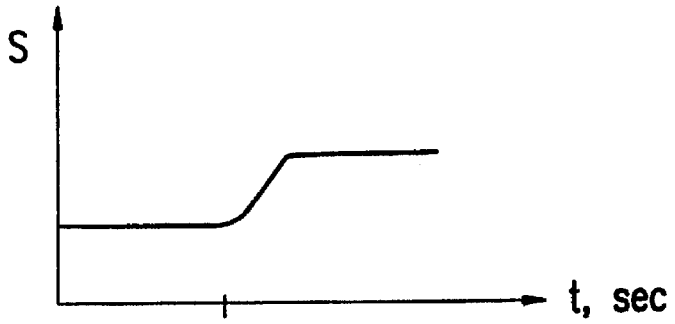
Figure 6C:
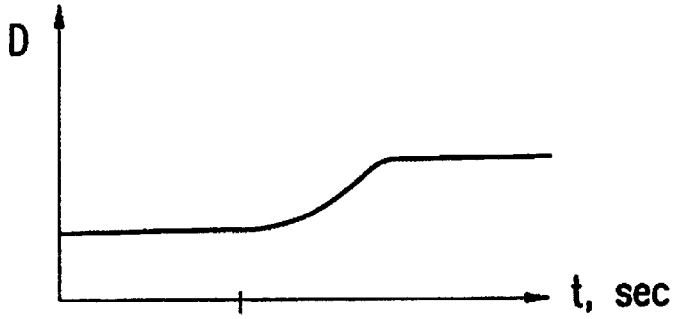

The weighting coefficients, A, for the filter may be determined as follows. For the purpose of illustration, consider the case where torque on the bit is the downhole condition of interest and the torque applied at the surface is the condition at the surface which produces the downhole condition. Where an actual surface torque applied over time is as shown in FIG. 6(*a*), the torque measured at the surface may be as shown in FIG. 6(*b*). This response, measured as discrete observations, may be modeled as the output, S, of a response function, $C_S$, having actual applied torque T as the input, such that:

$$S_i=\sum_{j=1}^{m} g_j T_k$$

where:

m is the selected level for the response function, $$k=i+j-\frac{m+1}{2}$$

$T_k$ is the actual torque applied at time $t_k$, and $g_j$ is a response coefficient representing the portion of the signal, S, that comes from level m.

Figure 7:
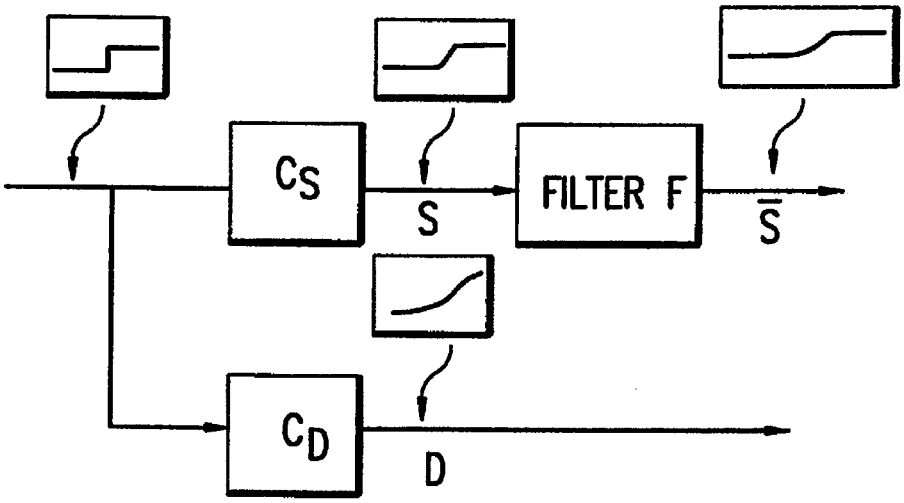
FIG. 7 shows a model of the measurements of FIG. 6, where the responses of the system are shown as transfer functions $C_S$ and $C_D$, and also showing a filter, F, for generating the filtered response $\overline{S}$.
Figure 3A:
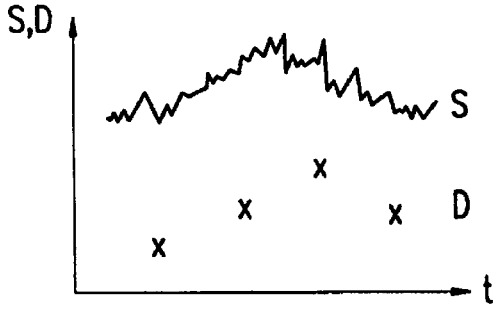
FIG. 3 graphically depicts a set of surface and downhole observations, and the results of processing the data set.
Figure 3B:
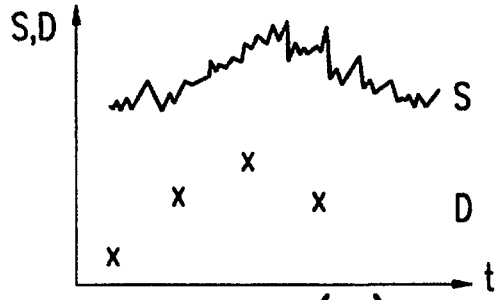
Figure 3C:
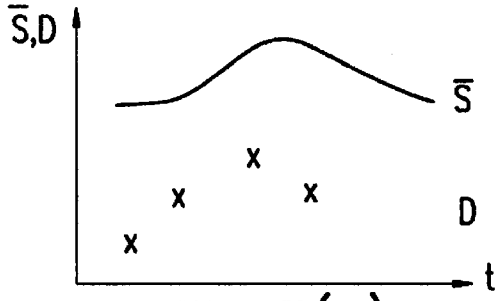
Figure 3E:
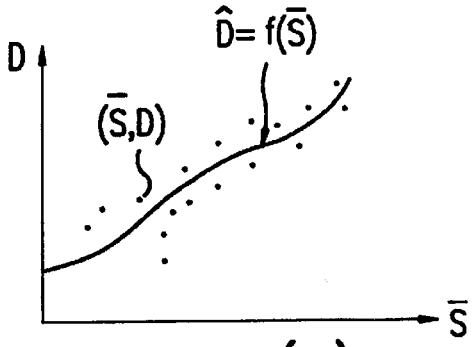
Figure 3D:
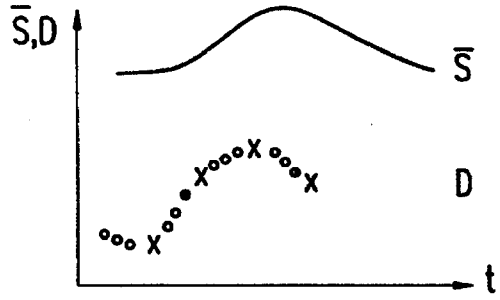
Figure 3F:
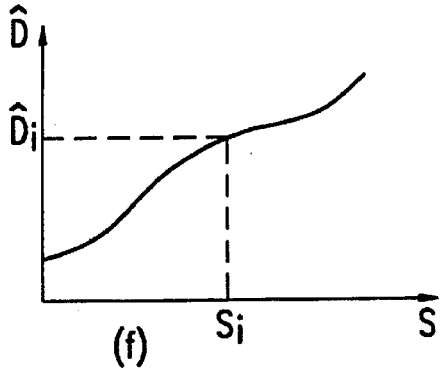

This response function, $C_S$, with T as input and S as output is shown schematically in FIG. 7.

The measured downhole response resulting from the applied torque may be as shown in FIG. 6(*c*). This observed downhole torque, is likewise modeled as the output, D, of a response function, $C_D$, shown in FIG. 7, where $$D_i=\sum_{j=1}^{n} h_j T_k$$

and where n is the selected level for the model, and $h_j$ is a response coefficient.

The number of levels, n, for the modeled downhole response will be larger than the number of levels for the surface measurement since the surface measurement has a higher frequency response.

The filter, F, for conforming the high frequency response of the surface measurement to that of the low frequency downhole measurement is shown in FIG. 7. The filter has surface measurement S as the input and filtered measurement $\bar{S}$ as the output. Filter F is modeled as a finite interval response filter, such that:

$$\bar{S}_i=\sum_{j=1}^{n} f_i g_i T_k$$

where:

$g_i$ is the same response coefficient as in the response function of S, and $f_i$ is another component so that the product $f_i g_i$ provides the overall weighting coefficient for filter F.

The above equations may be expressed in matrix form:

$$S_i=|g|\times|T|$$
$$D_i=|h|\times|T|$$
$$\bar{S}_i=|f|\times|g|\times|T|$$

In order for $\bar{S}_i$ to match $D_i$, $|f|\times|g|\times|T|$ must equal $|h|\times|T|$, which may be solved for $|f|$, to yield $|f|=|h|/|g|$.

Since the filter level n is larger than the filter level m, the resulting system of equations $|f|=|h|/|g|$ will be overdetermined. In such a case the best fit solution for $|f|$ may be calculated by a least squares optimization. For background or similar matrix calculations of response functions in a different context refer to Richard J. Nelson and William K. Mitchell, "Improved Vertical Resolution of Well Logs by Resolution Matching", *The Log Analyst*, July–August 1991.

Referring to FIG. 4, in the present example of a two level filter and a set of observations $S_1$ through $S_{240}$ measured over a 120 second period $P_1$, there will be a set of values $\overline{S}_3$ through $\overline{S}_{238}$, the values being measured over a 118 second period of time $P'_1$. Having determined the filter coefficients, values of $\overline{S}_i$ may be calculated from the observations of S. That is, from the set of r measured values of S during period $P_1$ there will be a smaller set of w weighted average values of $\overline{S}$ covering a period of time $P'_1$, since the calculation of a weighted average value for a certain observation of S requires observations of S measured before and after the time at which the certain S is measured. There will also be a corresponding set of w values of $S_i$ for the w values of $\overline{S}_i$ during the time $P'_1$. In the example of FIG. 4, r, which is the number of values of $S_i$ during the period $P_1$ and w, which is the number of values of $S_i$ and of $\overline{S}_i$ during the period $P'_1$, is 236.

In the present example there are only four measured observations of the downhole condition D during period $P_1$, shown as "X's" in FIGS. 3(*a*) through 3(*d*). Moreover, two of these values were measured at times outside the period of time $P'_1$ for which the values of $\overline{S}$ are calculated from the filter. Thus, in order to perform regression analysis of D and $\overline{S}$, preliminary values of D must be estimated to provide a set of values for D corresponding to the set of values for $\overline{S}$. Although other interpolation techniques may be used, in this example the preliminary set is developed by using non-linear interpolation for estimated values of $D_{61}$ through $D_{119}$ between measured values $D_{60}$ and $D_{120}$, etc. Of course if measurements began before the reference time $t_0$ of the present example a value of D was obtained that corresponds to the time just before time $t_0$. This value may be used together with $D_{60}$ for estimating $D_2$ through $D_{59}$. The interpolated values for D are shown as "O's" in FIG. 3(*d*).

Next a regression analysis is performed on the corresponding pairs of observations for $\overline{S}$ and D to determine a best fit curve (also referred to herein as a "predictor equation") which approximates D as a function of $\overline{S}$ according to the $N^{th}$ order model:

$$\hat{D}=B_0+B_1\overline{S}+B_2\overline{S}^2+\ldots B_N\overline{S}^N$$

See FIG. 3(*e*) which indicates the observations ($\overline{S}$,D) and the $\hat{D}=f(\overline{S})$ curve. Regression analysis is a well known technique for curve fitting wherein a fitted equation is selected so as to minimize the sum of the sequences of the differences between the actual observations and the fitted equation. See, for example, N. R. Draper and H. Smith, *Applied Regression Analysis,* 1981. This analysis determines a fitting coefficient which permits identification of how well the two measurements correlate.

After the predictor equation has been developed using the set of observations collected during time period $P_1$, ending at time $t_r$, the equation is applied to a surface condition measured at some time, say $t_I$ (shown in FIG. 5), to provide an immediate estimate of the resulting downhole condition, as shown in FIG. 3(*f*). To apply the predictor equation, the surface condition is measured, the unfiltered measurement is substituted for $\overline{S}$ in the predictor equation and the parameters $B_0$ through $B_N$ which were previously calculated are used. In the case of a torque condition, this yields an immediate prediction of the ultimate torque that will be delivered at the bit due to the measured torque applied at the surface. Since the only downhole measurements used to generate the prediction are past measurements and the surface measurement is immediately available, the prediction eliminates the time lag for transfer of the torque downhole and the delay for transmitting a downhole measurement to the surface. Since the data which is collected and the predictor equation which is formulated from the data empirically takes into account the effects of torque losses, the torque losses are eliminated to the extent possible within the limitations of the analysis.

In order to best assist the drilling operator, a display of the downhole condition, which may be a graphical or numerical display, may be generated. The predictor equation may be applied to succeeding observations of the surface condition to provide a systematically updated display.

Figure 8:
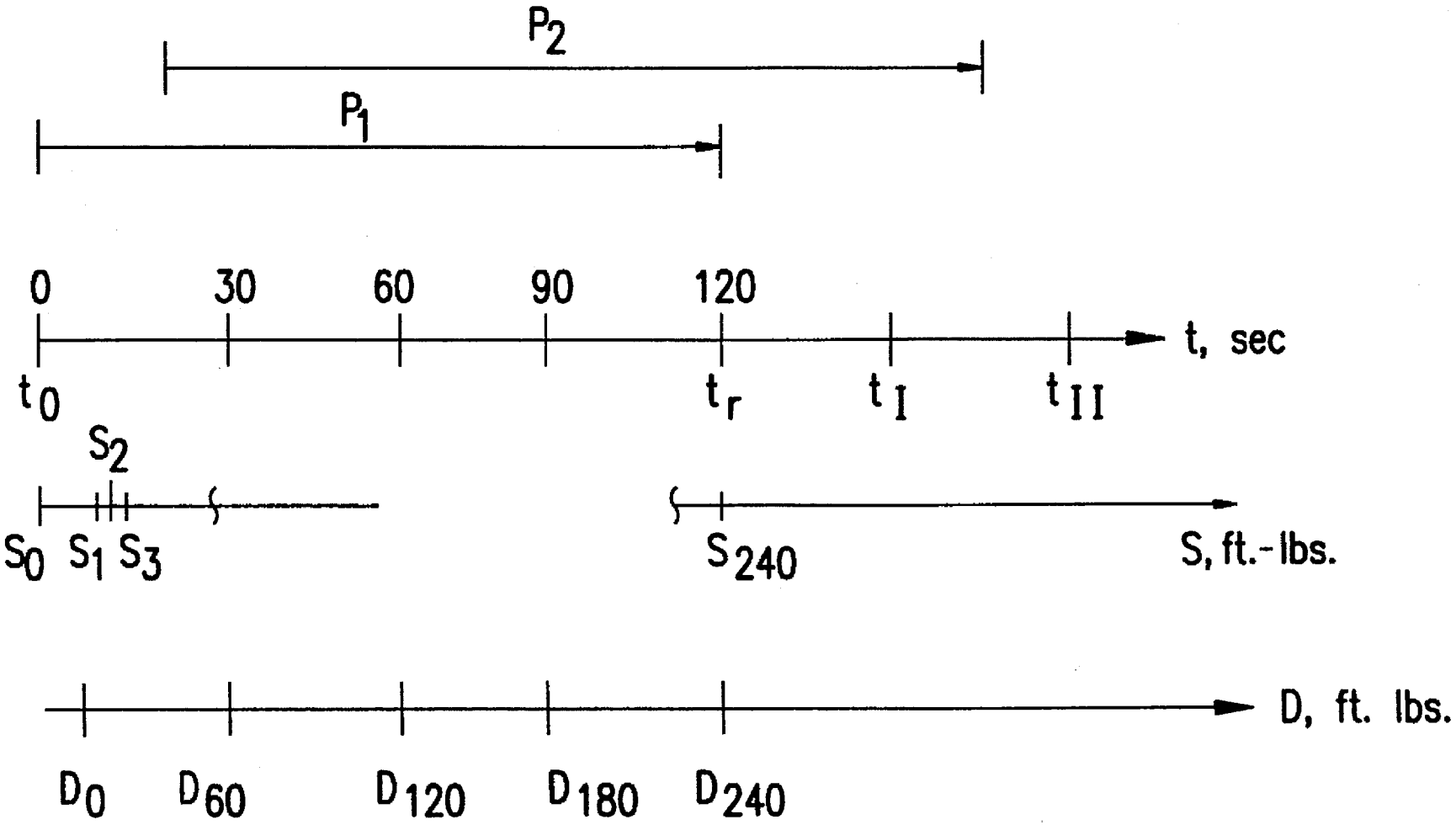
FIG. 8 shows a sequence of observations as in FIG. 5, followed by a second sequence of observations for an updated analysis.

The predictor equation itself may also be updated to take into account changing drilling conditions by collecting additional sets of surface and downhole measurements and deriving a new predictor equation. Returning to the torque example used earlier, and referring now to FIG. 8, a first updating of the predictor equation is accomplished by collecting a second set of downhole torque observations over a second period of time, $P_2$, which ends after time $t_r$, and before time $t_{II}$, the second set of observations being measured at q different times during the second period. During the same period $P_2$, a second set of surface drill string torque observations are collected at the same q times and also at additional times, resulting in a second collection of r observations of surface measured torque. The second set of r observations of surface torque are used to calculate a second set of filtered values of torque, and the second set of q observations of downhole torque are used to calculate additional interpolated values of downhole torque thereby providing a second set of downhole torque values which correspond to the second set of filtered surface values. The new set of downhole torque values and filtered surface values are then used to determine a new set of parameters for the predictor equation.

The predictor equation, now updated with new parameters $B_0$ through $B_N$ may then be applied by measuring a succeeding surface drill string torque at time $t_{II}$, substituting the unfiltered measurement for $\overline{S}$. This yields an immediate prediction of the ultimate torque which will be produced at the bit downhole due to the torque applied at the surface at time $t_{II}$, the prediction being based on a set of predictor equation parameters which have been updated for the observed conditions during period $P_2$.

While torque measurements have been mainly referred to in this description, it is understood that the same principles also apply to a variety of measured parameters, such as weight on the bit, bit rotational speed, drill string vibration (including axial and transverse), rate of penetration, mud flow rate, and mud pressure. Where the downhole condition of interest is mud flow rate, mud pressure, or drill string vibration (either axial or transverse), the same condition at the surface contributes to the downhole condition. In the case where the drill string has a downhole motor, the weight of the drill string that is supported at the surface, and the pressure on the surface at the inlet to the standpipe supplying fluid for driving the motor are surface measurable contributors to the downhole bit rotational speed. Otherwise the rotational speed of the drill string at the surface is a condition which contributes to the bit rotational speed downhole. The rate of drill string longitudinal travel at the top of the borehole is a measurable surface condition which contributes to the rate of penetration downhole. The invention is therefore limited only by the scope of the appended claims.

What is claimed is:

1. A drilling measurement apparatus for estimating a downhole condition while drilling in an earth formation, comprising:

means for collecting measurements of the downhole condition D;

means for collecting measurements of a condition S at the surface of the earth which contributes to the downhole condition D;

means for filtering the measurements of the surface condition S to produce a filtered measured surface condition $\bar{S}$;

computer means for deriving at least one parameter for a predictor equation from the measurements of the downhole and surface conditions, the predictor equation expressing the estimated downhole condition $\hat{D}$ as a function of the filtered measured surface condition $\bar{S}$ according to the $N^{th}$ order relationship $$\hat{D}=B_0+B_1\bar{S}+B_2\bar{S}^N; \text{ and}$$

computer means for applying the predictor equation to a measurement of the surface condition S to estimate the downhole condition which will result from that surface condition.

2. The apparatus of claim 1 further comprising graphic display means for displaying the estimated downhole condition.

3. The apparatus of claim 1 wherein the computer means for deriving at least one parameter for a predictor equation includes computer means for time shifting to match pairs of values of the downhole condition and the surface condition which correspond in time.

4. A method of estimating a downhole condition while drilling in an earth formation, comprising the steps of:

collecting measurements of the downhole condition D;

collecting measurements of a condition S at the surface of the earth which contributes to the downhole condition D;

filtering the measurements of the surface condition S to produce a filtered measured surface condition $\bar{S}$;

deriving at least one parameter for a predictor equation from the measurements of the downhole and surface conditions, the predictor equation expressing the estimated downhole condition $\hat{D}$ as a function of the filtered measured surface condition $\bar{S}$ according to the $N^{th}$ order relationship $$\hat{D}=B_0+B_1\bar{S}+B_2\bar{S}^2+\ldots B_N\bar{S}^N; \text{ and}$$

applying the predictor equation to a measurement of the surface condition S to estimate the downhole condition which will result from that surface condition.

5. A method of estimating a downhole condition D at least at a time, $t_I$, while drilling in an earth formation with a bit connected to a drill string, comprising the steps of:

collecting measurements of the downhole condition D;

collecting measurements of a surface condition S relating to the drill string;

interpolating additional values of D from the measurements of D;

filtering the measured values of S to derive the filtered measured surface condition $\bar{S}$;

using at least a portion of the measured and interpolated values of D and of the filtered measured values of S to determine at least one parameter B for predicting D as a function of $\bar{S}$ according to the $N^{th}$ order relationship $$\hat{D}=B_0+B_1\bar{S}+B_2\bar{S}^2+\ldots B_N\bar{S}^N;$$

sampling the value of S at the surface at time $t_I$; and calculating an estimated value of D using the value of S measured at time $t_I$ and the parameter B.

6. The method of claim 5 wherein the measurements of the downhole condition D are at q different times and the measurements of the surface condition S are at q different times and also at additional times, and wherein the measurements of the downhole condition D and the surface condition S are time shifted to identify pairs of measurements which correspond in time.

7. The method of claim 6 wherein, in collecting measurements of the downhole condition D, an average of numerous downhole measurements are computed downhole and the average is transmitted to the surface.

8. The method of claim 7 wherein the downhole condition D comprises torque on the bit and the surface condition S comprises torque on the drill string.

9. The method of claim 7 wherein the downhole condition D comprises torque on the bit and the surface condition S comprises pressure at an inlet to a standpipe supplying fluid to a downhole motor attached to the bit.

10. The method of claim 7 wherein the downhole condition D comprises mud flow rate and the surface condition S comprises mud flow rate at the surface.

11. The method of claim 7 wherein the downhole condition D comprises mud pressure and the surface condition S comprises mud pressure at the surface.

12. The method of claim 7 wherein the downhole condition D comprises axial drill string vibration and the surface condition S comprises axial drill string vibration at the surface.

13. The method of claim 7 wherein the downhole condition D comprises transverse drill string vibration and the surface condition S comprises transverse drill string vibration at the surface.

14. The method of claim 7 wherein the downhole condition D comprises bit rotational speed and the surface condition S comprises rotational speed of the drill string at the surface.

15. The method of claim 7 wherein the downhole condition D comprises bit rotational speed and the surface condition S comprises pressure at an inlet to a standpipe supplying fluid to a downhole motor attached to the bit.

16. The method of claim 7 wherein the downhole condition D comprises rate of penetration of the formation and the surface condition S comprises rate of drill string longitudinal travel at the surface.

17. The method of claim 5, further comprising the steps of:

collecting a second set of measurements of the downhole condition D, the second set of measurements occurring during a period $P_2$ which ends after time $t_I$ and before a time $t_{II}$;

collecting a second set of measurements of the surface condition S, the second set of surface condition measurements occurring during the period $P_2$;

interpolating additional values of D from the second set of measurements of D;

filtering the second set of measured values of S;

using at least a portion of the measured and interpolated values of D from the second set of measurements of D, and of the filtered measured values of S from the second set of measurements of S to determine a new value for the at least one parameter B;

sampling the value of S at the surface at time $t_{II}$; and calculating an estimated value of D according to said $N^{th}$ order relationship using the measurement of S at time $t_{II}$ and the parameter B.

18. A method of estimating a downhole measurement at least at a time, $t_l$, while drilling in an earth formation with a bit connected to a drill string, comprising the steps of:

collecting a first set of q measured values of a downhole condition D relating to the bit, the measurements occurring over a first period of time $P_1$ prior to the time $t_l$ and being measured at q different times during the first period of time $P_1$;

collecting a first set of r measured values of a surface condition S relating to the drill string, the surface conditions occurring during the first period of time $P_1$, so that the values are measured at q different times during the period $P_1$ and also at additional times during the period $P_1$;

defining a period of time $P_1'$ during period $P_1$ for which there are w measured values of S;

estimating values of D at certain times during $P_1'$ so that the measured values of D during period $P_1'$ together with the estimated values of D during period $P_1'$ provide w values of D in correspondence with the w values of S;

using the set of r measurements of S to calculate a first set of w values $\bar{S}$ of filtered S which correspond to the w values of S measured during $P_1'$;

using the first set of w values of $\bar{S}$ and the first set of w values of D to determine at least one parameter B for the $N^{th}$ order relationship $$\hat{D}=B_0+B_1\bar{S}+B_2\bar{S}^2+\ldots B_N\bar{S}^N;$$

measuring a value of S at the surface at time $t_1$; and calculating a first estimated value of D for the downhole bit using the measurement of S at time $t_l$, the parameter B, and said $N^{th}$ order relationship.

19. An apparatus for controlling a downhole condition while drilling in an earth formation comprising:

means for collecting measurements of the downhole condition;

means for collecting measurements of a condition at the surface of the earth which contributes to the downhole condition;

computer means for deriving a relationship between the downhole condition and the measured surface condition according to the $N^{th}$ order relationship $$\hat{D}=B_0+B_1\bar{S}+B_2\bar{S}^2+\ldots B_N\bar{S}^N;$$

computer means for applying said relationship to a measurement of the surface condition to determine the resulting downhole condition; and means for controlling the surface condition to effect changes in the downhole condition.

20. A drilling measurement apparatus for estimating a downhole condition while drilling in an earth formation, comprising:

means for collecting measurements of the downhole condition and for transmission of the measurements of the downhole condition to the surface of the earth;

means for collecting, at a frequency greater than the rate of transmission of the measurements of the downhole condition, measurements of a condition at the surface of the earth, which surface condition contributes to the downhole condition;

computer means for deriving at least one parameter for a predictor equation from the measurements of the downhole and surface conditions, the predictor equation expressing the downhole condition as a function of the measured surface condition according to the $N^{th}$ order relationship $$\hat{D}=B_0+B_1\bar{S}+B_2\bar{S}^2+\ldots B_N\bar{S}^N; \text{ and}$$

computer means for applying the predictor equation to a further measurement of the surface condition to estimate the downhole condition which will result from that surface condition.

21. The apparatus of claim 20 wherein the computer means for deriving at least one parameter for a predictor equation includes means for filtering the measurements of the surface condition.

22. The apparatus of claim 21 wherein the computer means for deriving at least one parameter for a predictor equation includes computer means for time shifting to match pairs of values of the downhole condition and the surface condition which correspond in time.

23. A method of estimating a downhole condition while drilling in an earth formation, comprising the steps of:

collecting measurements of the downhole condition and transmitting such measurements to the surface of the earth;

collecting measurements, at a frequency greater than the rate of transmission of the measurements of the downhole condition, of a condition at the surface of the earth, which condition contributes to the downhole condition;

deriving at least one parameter for a predictor equation from the measurements of the downhole and surface conditions, the predictor equation expressing the downhole condition as a function of the measured surface condition according to the $N^{th}$ order relationship $$\hat{D}=B_0+B_1\bar{S}+B_2\bar{S}^2+\ldots B_N\bar{S}^N; \text{ and}$$

applying the predictor equation to a measurement of the surface condition to estimate the downhole condition which will result from that surface condition.

24. The method of claim 23 wherein the measurements of the surface condition are filtered.

25. The method of claim 24 wherein the measurements of the downhole condition and the surface condition are time shifted to identify pairs of measurements which correspond in time.

* * * * *